US005839279A

United States Patent [19]

Moriya et al.

[11] Patent Number: 5,839,279

[45] Date of Patent: Nov. 24, 1998

[54] HYDRAULIC ACTUATOR OPERATION CONTROLLER

[75] Inventors: Naoyuki Moriya; Isao Murota; Makoto Hasuike, all of Tokyo, Japan

[73] Assignee: Shin Caterpillar Mitsubishi Ltd., Tokyo, Japan

[21] Appl. No.: 824,346

[22] Filed: Mar. 26, 1997

[30] Foreign Application Priority Data

Jun. 12, 1996 [JP] Japan ..... 8-173009

[51] Int. Cl.[6] ..... F16D 31/02

[52] U.S. Cl. ..... 60/445; 60/459

[58] Field of Search ..... 60/443, 444, 445, 60/328, 459

[56] References Cited

U.S. PATENT DOCUMENTS

| | | | |
|---|---|---|---|
| 4,823,552 | 4/1989 | Ezell et al. | 60/445 X |
| 4,884,402 | 12/1989 | Strenzke et al. | 60/445 X |
| 5,182,908 | 2/1993 | Devier et al. | 60/459 X |
| 5,249,421 | 10/1993 | Lunzman . | |
| 5,452,579 | 9/1995 | Freidrichsen | 60/328 |
| 5,493,861 | 2/1996 | Freidrichsen | 60/328 |
| 5,537,819 | 7/1996 | Kobayashi | 60/459 |

FOREIGN PATENT DOCUMENTS

| | | |
|---|---|---|
| 0 297 682 A2 | 1/1989 | European Pat. Off. . |
| 0 326 150 A1 | 8/1989 | European Pat. Off. . |
| 0 362 402 A1 | 4/1990 | European Pat. Off. . |
| 0 379 595 A1 | 8/1990 | European Pat. Off. . |
| 0 545 271 A1 | 6/1993 | European Pat. Off. . |
| 0 644 335 A1 | 3/1995 | European Pat. Off. . |
| 0 667 451 A1 | 8/1995 | European Pat. Off. . |
| 2 171 757 | 9/1986 | United Kingdom . |

OTHER PUBLICATIONS

Patent Abstract of Japan, Publication No. 02125032A, May 1990.

*Primary Examiner*—Hoang Nguyen
*Attorney, Agent, or Firm*—Oliff & Berridge, PLC

[57] ABSTRACT

A hydraulic actuator operation controller is shown to make it possible to easily change the operation speeds of a hydraulic actuator for a control input of an operating instrument. A signal input from a control input detection device for detecting the control input of an operating lever is converted according to a logical function by a signal conversion unit. The signal conversion unit increases or decreases the signal in magnitude and outputs the converted signal to a pump control device. The pump control device outputs an instruction to a capacity change device such as an electromagnetic proportional control valve connected to a hydraulic pump. The converted signal is also provided to a valve control device for outputting an instruction to a valve opening-degree control device such as electromagnetic proportional control valves connected to a control valve.

8 Claims, 6 Drawing Sheets

HYDRAULIC ACTUATOR OPERATION CONTROLLER

BACKGROUND OF THE INVENTION

1. Field of the Invention

The present invention is included in the technical field of a hydraulic actuator operation controller to be provided for a hydraulic excavator or similar hydraulic-powered machinery.

2. Description of the Related Art

In general, as shown in FIG. 5, there are some operation controllers of this type which are provided with pump control means 25 for inputting a signal from a control input detection means 17 for detecting a control input of a hydraulic-actuator operating instrument 16 and outputting a control command to the capacity change means (an electromagnetic proportional control valve 12 for supplying a pressurized oil for control of a pump swash plate to a hydraulic pump 10 in the case of FIG. 5) of a capacity-change hydraulic pump 10 for supplying a pressurized oil to a hydraulic actuator 7 in accordance with the input signal and valve control means 26 for outputting a control command to the opening-degree control means (electromagnetic proportional control valves 14U and 14D in the case of FIG. 5) of a control valve 13 for controlling the flow rate of the pressurized oil to be supplied to the hydraulic actuator 7.

In the case of the above operation controllers, the valve control means 26 is set so as to output a control command in accordance with the spool stroke characteristic (shown in FIG. 6Z) of the control valve 13 corresponding to the control input of the operating instrument 16 and the pump control means 25 is set so as to output a control command in accordance with the pump swash plate displacement characteristic (shown in FIG. 6Y) of the hydraulic pump 10 corresponding to the control input of the operating instrument 16. In this case, however, the spool stroke of the control valve, that is, the opening area of the valve and the capacity of the hydraulic pump are previously set so that a proper relation is kept between them. That is, the problems occur that a high pressure is produced between the hydraulic pump and the control valve if the amount of oil supplied from the hydraulic pump is too much for the opening area of the control valve. Furthermore, the hydraulic actuator is brought under a vacuum state if the amount of oil supplied from the hydraulic pump is too little for the opening area of the control valve. Therefore, the opening area of the valve and the capacity of the hydraulic pump must be set so that the above problems do not occur.

In recent years, there has been a request for making it possible to optionally change the operation speed of a hydraulic actuator for the control input of an operating instrument as required in order to compensate for the individual difference or the operation content of an operator in order to improve the workability and operability.

Therefore, it is advocated for the above operation controller that the opening area of the control valve for the control input of the operating instrument can be changed by operation means such as an adjusting dial. In this case, however, the opening area of the control valve and the capacity of the hydraulic pump must be kept at a preset relation as described above. Therefore, when the opening area of the control valve is changed corresponding to the control input of the operating instrument, the pump swash plate displacement value of the hydraulic pump must also be changed so as to have the above-described corresponding relation. However, there is a problem that the above control is practically difficult. Therefore, an object of the present invention is to solve the aforementioned problems.

Moreover, there is a request for making it possible to optionally change the limited rate or response per unit time of a hydraulic actuator corresponding to the operation of an operating instrument.

SUMMARY OF THE INVENTION

The present invention is created to solve the above problems. A hydraulic actuator operation controller according to an embodiment of the present invention comprises pump control means for inputting a signal corresponding to a control input of a hydraulic-actuator operating instrument and outputting a control command according to the input signal to capacity change means of a hydraulic pump. The hydraulic pump supplies an oil pressure to a hydraulic actuator. A valve control means is provided for also inputting the signal corresponding to the control input and for outputting the control command according to the input signal to the opening-degree control means of a control valve for controlling the flow rate of the pressure oil to be supplied to the hydraulic actuator. The operation controller is provided with signal conversion means capable of converting the input signal in accordance with one of a plurality of preset logical functions and outputting a signal converted according to a logical function optionally selected out of the plurality of preset logical functions to the pump control means and the valve control means. The signal input from the operating instrument is converted according to a logical function selected by the signal conversion means, the converted signal is output to the pump control means and the valve control means, and the operation speed of the hydraulic actuator for the control input of the operating instrument can easily be changed while keeping a proper relationship between the opening area of the control valve and the amount of oil supplied from the hydraulic pump. Thus, the operability and workability are improved over conventional systems.

Moreover, because the limited rate of the control commands of the pump control means and valve control means corresponding to the signal input from the operating instrument is adjusted to a limited rate optionally selected out of a plurality of preset limited rates, the limited rate of the hydraulic pump and the control valve corresponding to the operation of the operating instrument can be adjusted and the operability and workability are further improved.

Furthermore, in the operation controller according to a preferred embodiment of the present invention, because a logical function and limited rate to be selected are determined by selecting any one of a plurality of combined modes set by optionally selecting one logical function and one limited rate out of a plurality of logical functions and a plurality of limited rates respectively, the logical function and the limited rate can simultaneously and easily be selected by the selecting operation means and thereby, the operability can further be improved.

DESCRIPTION OF THE PREFERRED EMBODIMENT

Figure 1:
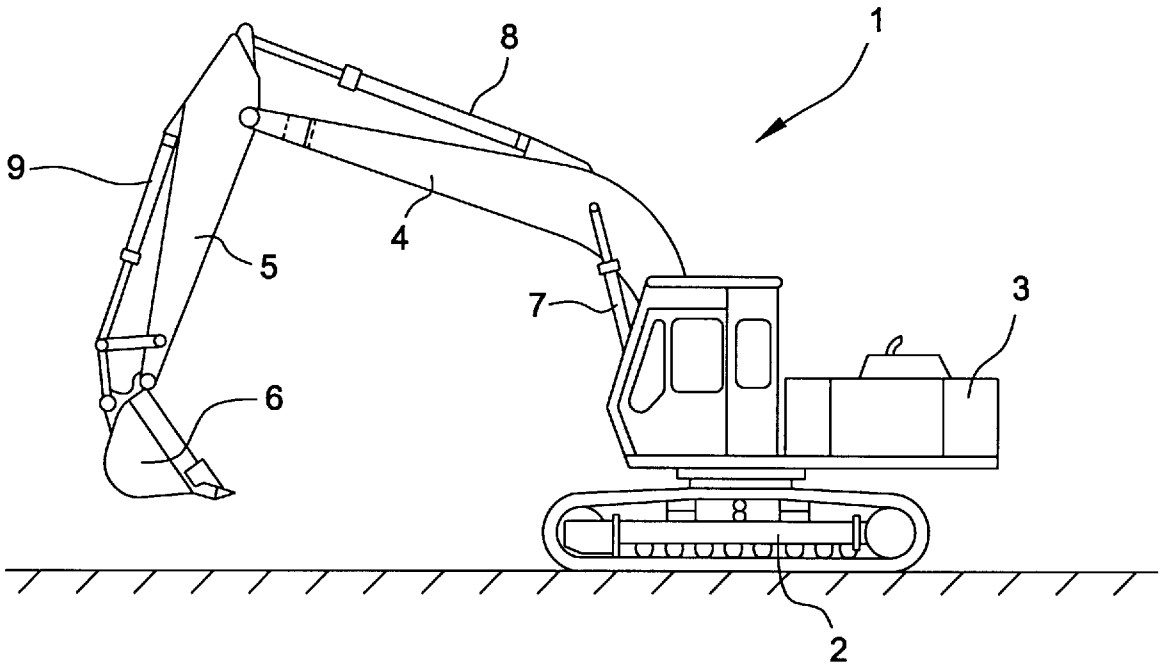
FIG. 1 is a side elevation view of a hydraulic excavator.

The preferred embodiment of the present invention is described below by referring to the accompanying drawings. In FIG. 1, reference character 1 denotes a hydraulic excavator. The hydraulic excavator 1 comprises a crawler-type lower structure 2, a top revolving superstructure 3 rotatably supported above the lower structure 2, a boom 4 whose proximal end is vertically, pivotally supported at the front end of the top revolving superstructure 3, a stick 5 longitudinally, pivotally supported at the front end of the boom 4, and a bucket 6 pivotally supported at the front end of the stick 5. Moreover, the excavator 1 is provided with a traveling motor and a swing motor (which are not illustrated), and various types of actuators such as a boom cylinder 7, a stick cylinder 8, and a bucket cylinder 9. Therefore, the basic structure of the excavator 1 is the same as that of a conventional one. In the case of this embodiment, though the present invention is applied to an operation controller for operating each of the above hydraulic actuators, it can similarly be applied to any type of hydraulic actuator. Therefore, the case of the boom cylinder 7 is described below as an example.

The boom cylinder 7 extends or contracts in accordance with the pressurized oil supplied from the hydraulic pump 10 to be driven by the motive power of an engine. However, the hydraulic pump 10 is the variable capacity type comprising a swash plate type axial piston pump whose discharge flow rate changes in accordance with the tilt angle displacement of a pump swash plate 10*a*, shown in FIG. 2, and the swash plate regulator 11 of the hydraulic pump 10 is constituted so as to control the tilt of the pump swash plate 10*a* corresponding to the pressure of pilot pressure oil supplied from a first electromagnetic proportional control valve 12 to be mentioned later.

Moreover, in the drawings, symbol 13 denotes a control valve set in an oil channel extending from the hydraulic pump 10 to the boom cylinder 7. The spool stroke of the control valve 13 is changed in accordance with the pressure change of the pilot pressure oil supplied from second electromagnetic proportional control valves 14U and 14D to be mentioned later. The pressurized oil is supplied to pilot ports 13U and 13D and the valve 13 comprises a flow rate control valve for supplying pressurized oil at a flow rate corresponding to the spool stroke to the boom cylinder 7.

Figure 2:
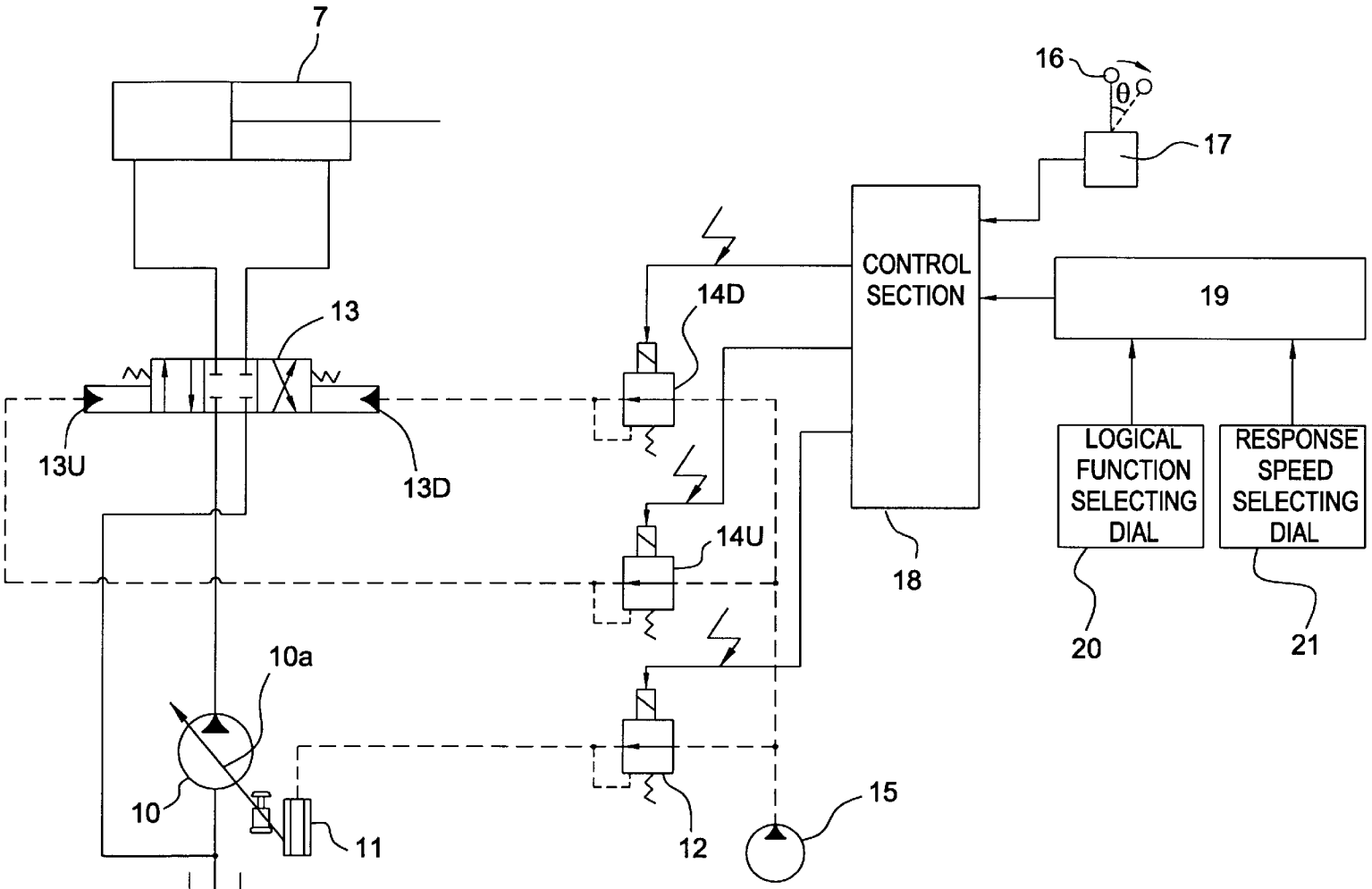
FIG. 2 is a schematic representation of the operation controller of a boom cylinder.

In FIG. 2, reference character 15 denotes a pilot pump for supplying pressurized oil to the first electromagnetic proportional control valve 12 and the second electromagnetic proportional control valves 14U and 14D.

Furthermore, reference character 16 denotes a lever for operating the boom cylinder 7. In the case of the operating lever 16, the control input of an operator, that is, an operation angle θ from a neutral position, is detected by the control input detection means 17, and the detection signal is input to a control section 18 to be mentioned later.

The control section 18 comprises a microcomputer or other electronic processing unit, which inputs signals from the control input detection means 17 and a mode change switch 19 to be mentioned later and outputs a control command to the first electromagnetic proportional control valve 12 and the second electromagnetic proportional control valves 14U and 14D in accordance with these input signals.

Figure 3:
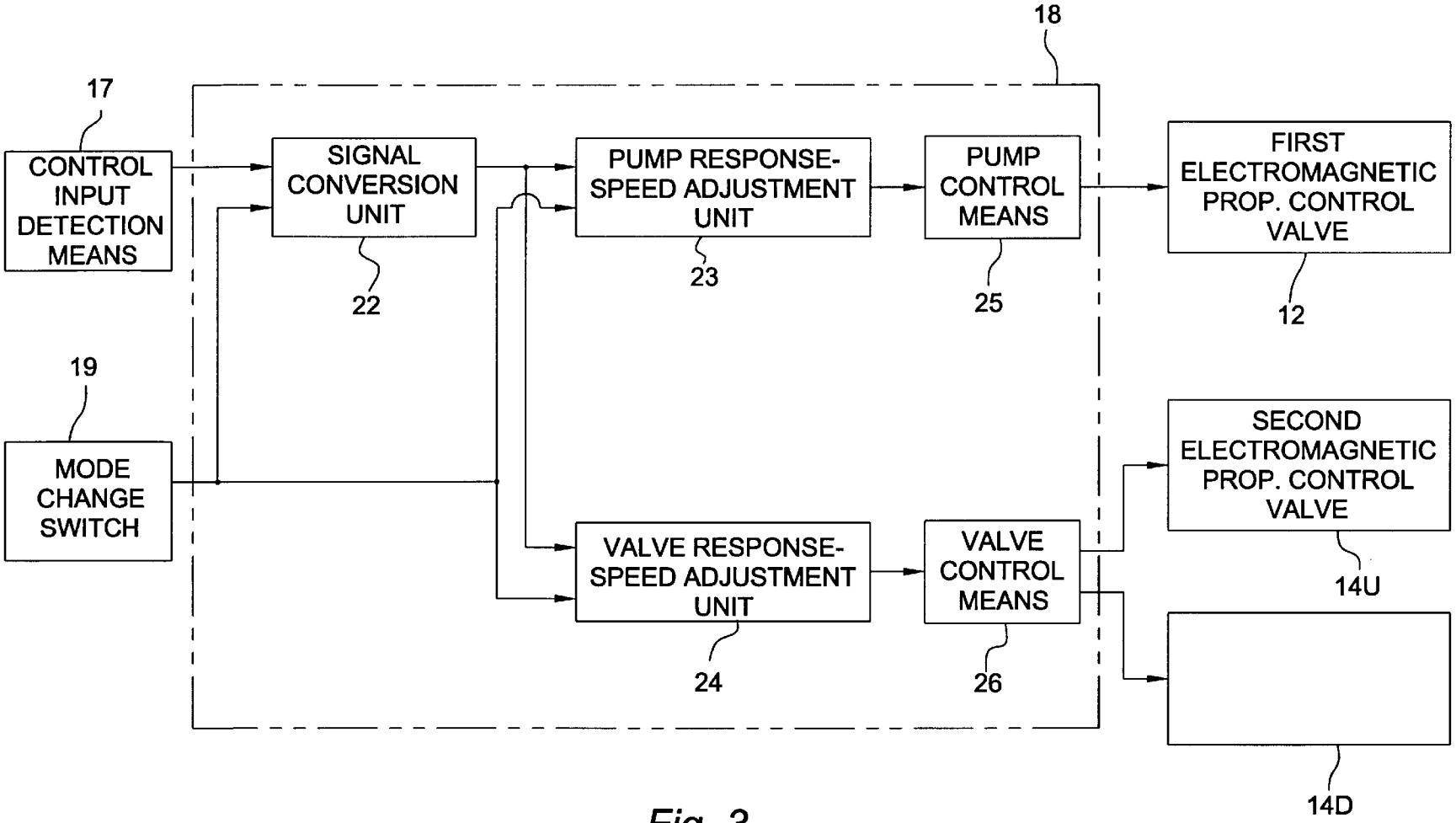
FIG. 3 is a block schematic showing the structure of a control section.

The structure of the control section 18 is described below by referring to FIG. 3. In FIG. 3, reference character 22 denotes a signal conversion unit. The signal conversion unit 22 is set so as to input a signal from the control input detection means 17 and convert the magnitude of the input signal (that is, the magnitude of the control input of the operating lever 16) according to a plurality of preset logical functions before outputting the resultant output signal.

Figure 4V:
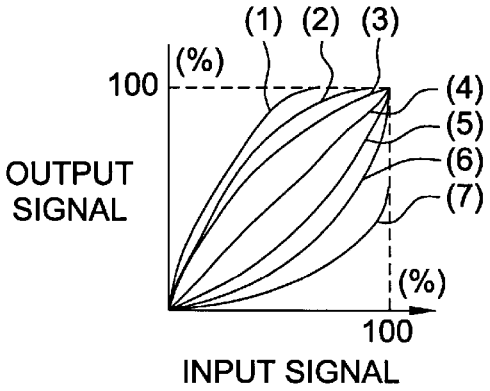
FIG. 4V is a graphic diagram showing logical functions.

Specifically, in the case of this embodiment, seven types of logical functions are set as shown by (1) to (7) in FIG. 4V. That is, the conversion unit 22 is set so as to output a converted input signal by increasing the input signal in magnitude according to one of the logical functions (1) to (3); keeping the output signal directly proportional to the input signal according to the logical function (4); or decreasing the input signal in magnitude according to one of the logical functions (5) to (7). A logical function to be adopted out of the above-described logical functions can be selected by the mode change switch 19.

Moreover, the signal output from the signal conversion unit 22 is input to a pump rate limiter 23 and a valve rate limiter 24.

Figure 4Y:
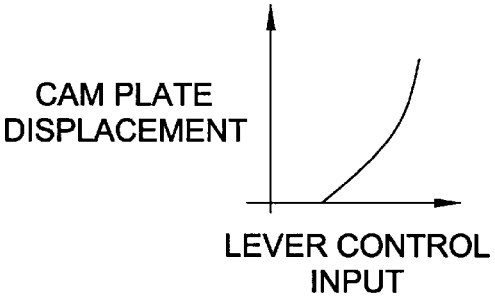
FIG. 4Y is a graphic diagram showing a cam-plate displacement characteristic.
Figure 4W:
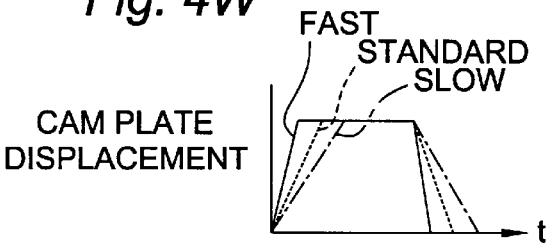
FIG. 4W is a graphic diagram showing pump limited rates.
Figure 4Z:
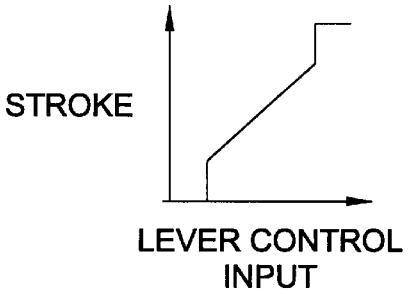
FIG. 4Z is a graphic diagram showing a spool stroke characteristic.
Figure 4X:
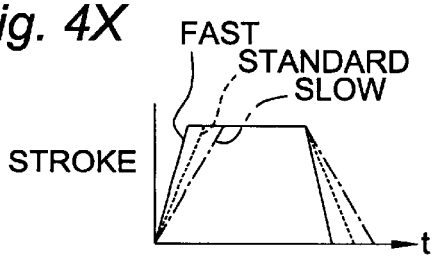
FIG. 4X is a graphic diagram showing valve limited rates.
Figure 5:
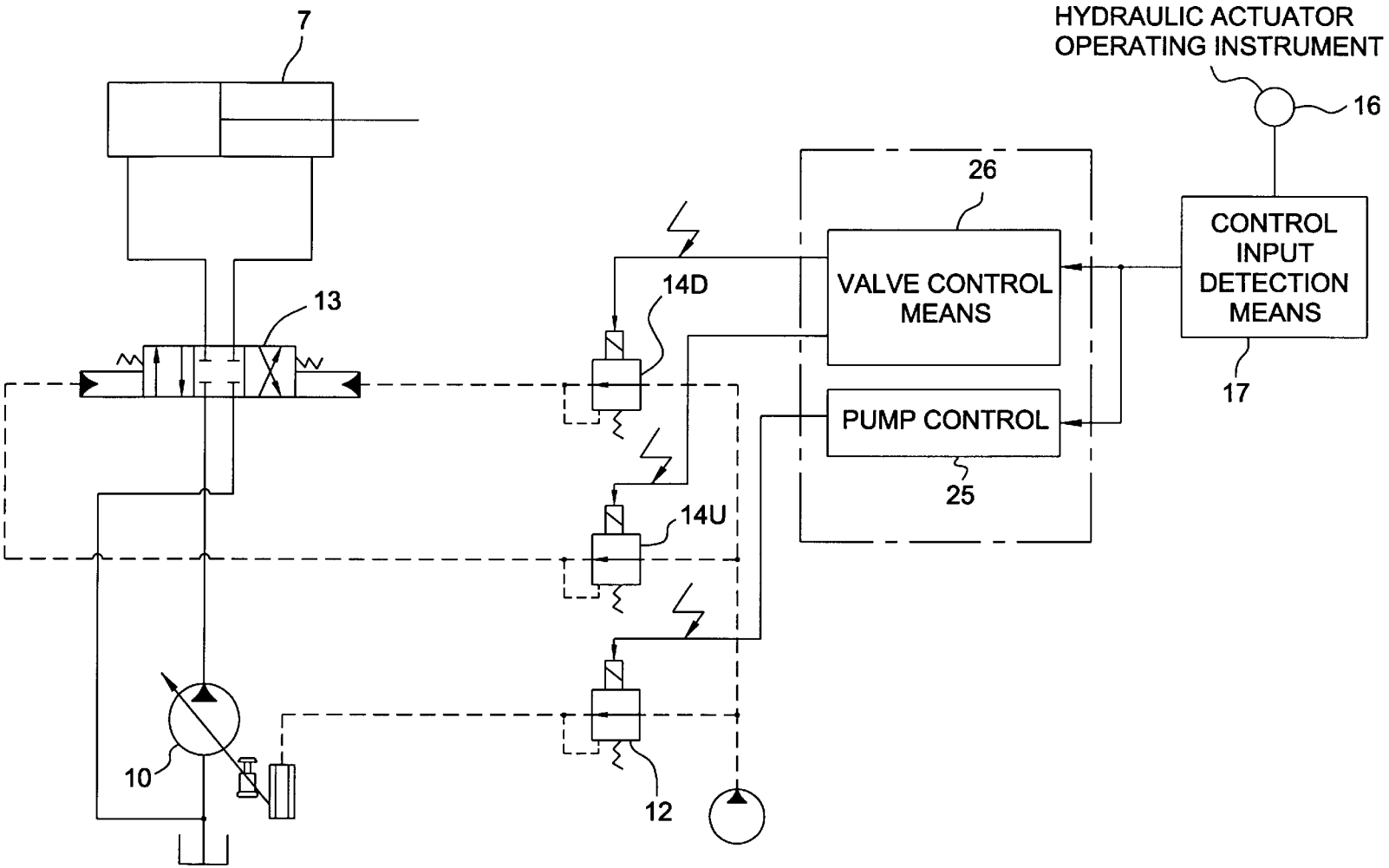
Fig. 5 RELATED ART
FIG. 5 is a block schematic showing a conventional operation controller.
Figure 6Y:
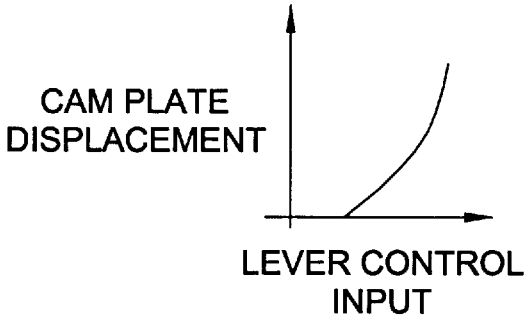
FIG. 6Y is a graphic diagram showing a conventional cam-plate displacement characteristic.
Figure 6Z:
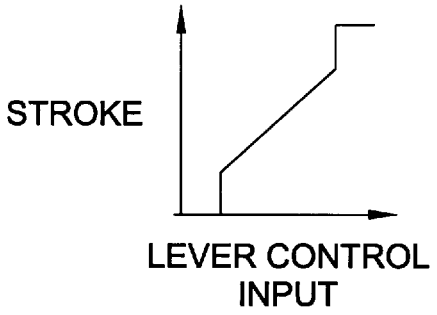
FIG. 6Z is a graphic diagram showing a spool stroke characteristic.

The rate limiters 23 and 24 restrict respectively the rate of pump swash plate displacement and the rate of spool movement of the control valve 13 when operating the operating lever 16. The relationship between the operation of the operating lever 16 and the opening movement of the control valve 13 is explained as follows: Namely, when operating the lever 16, a certain relationship is set between the operation angle from a neutral position of the operating lever 16 and the opening area of the control valve 13. Therefore when the lever 16 is operated from the neutral position to an optional position, the control valve 13 opens so as to achieve the preset opening area corresponding to said optional position (optional operation angle). An opening rate of the valve 13 is defined as a change in the values of the opening area of the valve 13 per unit time and is set not to exceed a preset upper limited rate. If the operating lever 16 is operated at a slow speed not exceeding the upper limited rate, the opening area of the control valve 13 changes at the rate of the operating speed of the lever. If the lever 16 is operated at a speed exceeding the upper limited rate, the opening area of the valve 13 is controlled to change based upon said upper limited rate instead of the operating speed of the lever 16. This relationship is also applied to the pump swash displacement. According to a preferred embodiment, three levels of limited rates, "fast", "standard", and "slow" are set to the pump rate limiter 23 and the valve rate limiter 24 respectively, as shown in FIGS. 4W and 4X. Moreover, this embodiment is constituted so that a limited rate to be adopted can be selected by the mode change switch 19.

The mode change switch 19 is a switch for changing three preset modes of A, B, and C in the case of this embodiment, in which modes are changed in the sequence of A→B→C→A . . . whenever pressing the switch 19.

In this case, the modes A, B, and C are combinations selected out of the above seven types of logical functions and the three types of limited rates by a logical function selecting dial 20, shown in FIG. 2, and a limited rate selecting dial 21, which can optionally be set by an operator in accordance with the operator's skill or operation content. For example, the mode A is set as the combination of the logical function (1) in FIG. 4V for increasing an input signal in magnitude, with the limited rate "fast". Mode B is set as the combination of the logical function (4) in FIG. 4V, with the limited rate "standard". Mode C is set as the combination of the logical function (7) in FIG. 4V for decreasing the input signal in magnitude, with the limited rate "slow". Though three modes are preset in the case of this embodiment, any number of modes up to the total number of possible combinations of logical functions and limited rates can be preset.

A signal output from the mode change switch 19 is input to the signal conversion unit 22, pump rate limiter 23, and valve rate limiter 24. For example, when the mode change switch 19 is set to the mode A, the logical function (1) is selected by the signal conversion unit 22 and the limited rate "fast" is selected by the pump rate limiter 23 and the valve rate limiter 24.

Symbol 25 denotes pump control means. The pump control means 25 inputs a signal sent from the pump rate limiter 23 and outputs a control command to the first electromagnetic proportional control valve 12 in accordance with the swash plate displacement characteristic (FIG. 4Y) of the hydraulic pump 10 for the preset control input of the operating lever 16 in order to control the pump swash plate of the hydraulic pump 10 corresponding to the input signal. The swash plate displacement value for the control input of the operating lever 16 is set at the preset swash plate displacement characteristic when the logical function (4) has been selected. As explained above, the signal input from the control input detection means 17 is output at the original magnitude by the signal conversion unit 22 when logical function 4 has been selected from the plurality of available logical functions shown in FIG. 4V.

Reference character 26 in FIG. 3 denotes valve control means. The valve control means 26 is constituted so as to input a signal sent from the valve rate limiter 24 and output a control command to the second electromagnetic proportional control valves 14U and 14D in accordance with the spool stroke characteristic (shown in FIG. 4Z) for the preset control input of the operating lever 16 in order to control the opening area of the control valve 13 corresponding to the input signal. The spool stroke for the control input of the operating lever 16 is set at the preset spool stroke characteristic, similarly to the case of the pump control means 25 when the logical function (4) has been selected. As explained above, the signal input from the control input detection means 17 is output at the original magnitude by the signal conversion unit 22 when logical function 4 has been selected from the plurality of available logical functions shown in FIG. 4V.

The swash plate displacement characteristic set to the pump control means 25 is related with the spool stroke characteristic set to the valve control means 26 so that the amount of pressurized oil supplied from the hydraulic pump 10 becomes proper for the opening area of the control valve 13.

In the above structure, when it is detected by the control input detection means 17 that the operating lever 16 is operated, the control section 18 controls the opening area of the control valve 13 and the discharge quantity of the hydraulic pump 10 in order to extend or contract the boom cylinder 7 in correspondence with the signal input from the control input detection means 17. In this case, an operator can easily change the extension or contraction speed of the boom cylinder 7 for the control input of the operating lever 16.

The control section 18 is provided with the signal conversion unit 22 for converting the magnitude of a signal input from the control input detection means 17 according to one of a plurality of preset logical functions to a corresponding output signal. The output signal varies according to a logical function selected out of the logical functions shown in FIG. 4V by the mode change switch 19. The converted output signal is input to the pump control means 25 and the valve control means 26 through the pump rate limiter 23 and the valve rate limiter 24. Moreover, control commands are output to the first electromagnetic proportional control valve 12 and the second electromagnetic proportional control valves 14U and 14D from the control means 25 and 26 and thereby, the capacity of the hydraulic pump 10 and the opening area of the control valve 13 are controlled and the boom cylinder 7 is extended or contracted correspondingly to these types of control.

Thus, in the case of the above-described embodiment of the Applicant's present invention, a signal input from the control input detection means 17 is converted to an output signal with a magnitude selected by an operator by the signal conversion unit 22. The magnitude-converted signal is output to the pump control means 25 and the valve control means 26. As a result, it is possible to simultaneously change the spool stroke of the control valve 13 for the control input of the operating lever 16 and the swash plate displacement value of the hydraulic pump 10 without changing the spool stroke characteristic and the swash plate displacement characteristic set to the valve control means 26 and the pump control means 25 respectively. Therefore, the proper relationship is maintained between the opening area of the control valve 13 and the amount of oil supplied from the hydraulic pump 10. Thus, it is possible to easily change the extension or contraction speed of the boom cylinder 7 for the control input of the operating lever 16 correspondingly to the individual difference or operation state such as operation content of an operator and thereby, the operability and workability are greatly improved.

Conversion of an input signal is performed by the signal conversion unit 22 in accordance with a selected preset logical function. When one of preset logical functions (1), (2), or (3) in FIG. 4V is selected, the output signal is increased in magnitude relative to the input signal, thus making it possible to perform efficient operations because the boom cylinder 7 is quickly extended or contracted in accordance with a slight lever control input. When the output signal from signal conversion unit 22 is decreased in magnitude relative to the input signal, according to one of logical functions (5), (6), or (7) in FIG. 4V, it is possible to perform fine operations because the boom cylinder 7 is slowly extended or contracted in accordance with the same lever control input.

Moreover, this embodiment makes it possible to adjust the limited rate of the hydraulic pump 10 and that of the control valve 13 because it is provided with the pump rate limiter 23 and the valve rate limiter 24. In this case, by operating the mode change switch 19, it is possible to simultaneously change the logical functions and the limited rates by one touch and further improve the operability and workability.

What is claimed is:

1. A hydraulic actuator operation controller, comprising:

signal conversion means for converting an input signal that corresponds to a control input of a hydraulic actuator operating instrument, said conversion being performed according to one of a plurality of preset logical functions, wherein at least one of said preset logical functions increases the magnitude of said converted input signal relative to said input signal, and at least one of said preset logical functions decreases the magnitude of said converted input signal relative to said input signal, and for outputting said converted input signal;

pump control means for inputting said converted input signal and outputting a pump control command to a capacity change device that regulates output of an oil pump supplying pressurized oil to a hydraulic actuator; and valve control means for inputting said converted input signal and outputting a valve control command to an opening-area control device that operates a control valve to control a flow rate of the pressurized oil to the hydraulic actuator.

2. The hydraulic actuator operation controller according to claim 1, further including:

pump rate limiter means for setting at least one upper limited rate of pump capacity changes per unit time produced by said capacity change device and valve rate limiter means for setting at least one upper limited rate of opening area changes of a valve operated by said opening area control device.

3. The hydraulic actuator operation controller according to claim 2, further including:

a mode control means for selecting a combination mode from a plurality of combination modes that are each set by selecting a preset logical function from a plurality of preset logical functions and selecting a limited rate from a plurality of limited rates.

4. The hydraulic actuator operation controller according to claim 1, further including:

pump rate limiter means for setting at least one upper limited rate of pump capacity changes per unit time produced by said capacity change device and valve rate limiter means for setting at least one upper limited rate of opening area changes of a valve operated by said opening area control device.

5. The hydraulic actuator operation controller according to claim 4, further including:

a mode control means for selecting a combination mode from a plurality of combination modes that are each set by selecting a preset logical function from a plurality of preset logical functions and selecting a limited rate from a plurality of limited rates.

6. A method of controlling a hydraulic actuator, said method comprising the steps of:

receiving an input signal corresponding to a control input of a hydraulic actuator operating instrument;

converting said input signal according to one of a plurality of preset logical functions, wherein at least one of said preset logical functions increases the magnitude of said converted input signal relative to said input signal, and at least one of said preset logical functions decreases the magnitude of said converted input signal relative to said input signal;

inputting the converted input signal and using an outputted signal to regulate the output of an oil pump supplying pressurized oil to a hydraulic actuator; and further inputting said converted input signal to operate a control valve that controls a flow rate of the pressurized oil to the hydraulic actuator.

7. The method according to claim 6, further including the steps of:

setting at least one limited rate of capacity change of the oil pump and at least one limited rate of opening area change of the control valve.

8. The method according to claim 6, further including the steps of;

selecting a preset logical function from a plurality of preset logical functions, selecting a limited rate from a plurality of limited rates, setting a plurality of combination modes in accordance with said selected logical function and said selected limited rate, and selecting a combination mode from said plurality of combination modes.

* * * * *